343-700 MS AU 254 EX
5/4/82 OR 4,328,500

United States Patent [19]
Alia et al.

[11] 4,328,500
[45] May 4, 1982

[54] INTEGRATED ANTENNA ARRAY FOR RADAR EQUIPMENT ENABLING THE SIMULTANEOUS GENERATION OF TWO OR MORE DIFFERENT RADIATION PATTERNS

[75] Inventors: Francesco Alia; Stefano Barbati, both of Rome, Italy

[73] Assignee: Contraves Italiana S.p.A., Rome, Italy

[21] Appl. No.: 158,466

[22] Filed: Jun. 11, 1980

[30] Foreign Application Priority Data

Jun. 14, 1979 [IT] Italy ..... 23567 A/79

[51] Int. Cl.[3] ..... H01Q 1/38
[52] U.S. Cl. ..... 343/700 MS; 343/840; 343/846
[58] Field of Search ..... 343/700 MS, 726, 725, 343/727, 729, 730, 840, 846

[56] References Cited

U.S. PATENT DOCUMENTS

| | | | |
|---|---|---|---|
| 3,445,850 | 5/1969 | Stegen | 343/840 |
| 3,550,135 | 12/1970 | Bodmer | 343/725 |
| 4,095,230 | 6/1978 | Salmond et al. | 343/700 MS |
| 4,142,190 | 2/1979 | Keer | 343/700 MS |
| 4,195,301 | 3/1980 | Conroy | 343/700 MS |

*Primary Examiner*—David K. Moore
*Attorney, Agent, or Firm*—Amster, Rothstein & Engelberg

[57] ABSTRACT

An integrated radar antenna array consists of a first antenna, in which an exciter is positioned at a focal length of a double curvature reflector with different height and width dimensions to generate a first directional radiation pattern, and a second antenna comprising the reflector of the first antenna and a plurality of micro strip surfaces fitted to the double curvature of the reflector and suitably secured thereon.

The radiating micro strip surface is positioned on the reflector at a distance $d = K\lambda/2$ where $\lambda$ = wavelength of the exciter frequency and K can be 0,1,2,3 . . . n.

3 Claims, 5 Drawing Figures

INTEGRATED ANTENNA ARRAY FOR RADAR EQUIPMENT ENABLING THE SIMULTANEOUS GENERATION OF TWO OR MORE DIFFERENT RADIATION PATTERNS

This invention relates to integrated antenna arrays for radar equipment.

Integrated antenna radar arrays are well known. They consist of an exciter and a reflector which carries at the same time a dipole array or also slot antennas. These arrays have the advantage, with respect to arrays consisting of individual independent antennas, of reducing weight and overall dimensions, however, they have the disadvantage that the energy radiated by the exciter is partially blanked by the dipoles secured on the reflector. This blanking can cause under certain circumstances an increment of the side lobes and a reduction or distortion of the main lobe depending on the structure and positioning of the dipoles or slot antennas. It is well known that by using integrated slot antennas in the reflector structure a blanking can be avoided; the slot antennas, however, build up intrinsically so called "blind spots" on the reflector which hinder a perfect reflection. It should be added that the polarization of the dipoles or slot antennas can be changed only at a comparatively high cost whereby the above mentioned advantages are reduced.

Like the integrated antenna arrays, micro strip antennas are also well known. They consist of conductive surfaces having a specific shape and size, which are positioned in parallel over larger earthed conductive surfaces from which they are separated by dielectric material layers. Depending on the shape and size, these antennas can operate with the most diversified frequencies and polarizations. Their structure can be very light and strong with a lower manufacturing, installation and servicing cost with respect to the conventional antennas having the same performances.

The invention is based on the requirement to provide an antenna array in which the advantages of micro strip antennas are combined with those of the conventional antennas so as to obtain an integrated antenna whose application field, especially in the application on mobile means, is substantially incremented because of the reduction of weight, operation irregularities and manufacture cost by virtue of servicing simplicity and interchangeablility of the radiating surface enabling to use an ample range of various frequencies and polarizations.

More particularly, the integrated radar antenna array according to the invention consists of a first antenna, in which an exciter is positioned at the focal length of a double curvature reflector with different hight and width dimensions to generate a first directional radiation pattern, and a second antenna comprising the reflector of the first antenna and a plurality of micro strip surfaces fitted to the double curvature of the reflector and suitably secured thereon, and is characterized in the radiating micro strip surface is positioned on the reflector at a distance $d=K\lambda/2$ where $\lambda$=wavelength of the exciter frequency and K can be 0,1,2,3 . . . n.

The invention will be better understood from the following detailed description, given merely by way of example and therefore in no limiting sense, of an embodiment thereof referring to the accompanying drawings in which.

Figure 1:
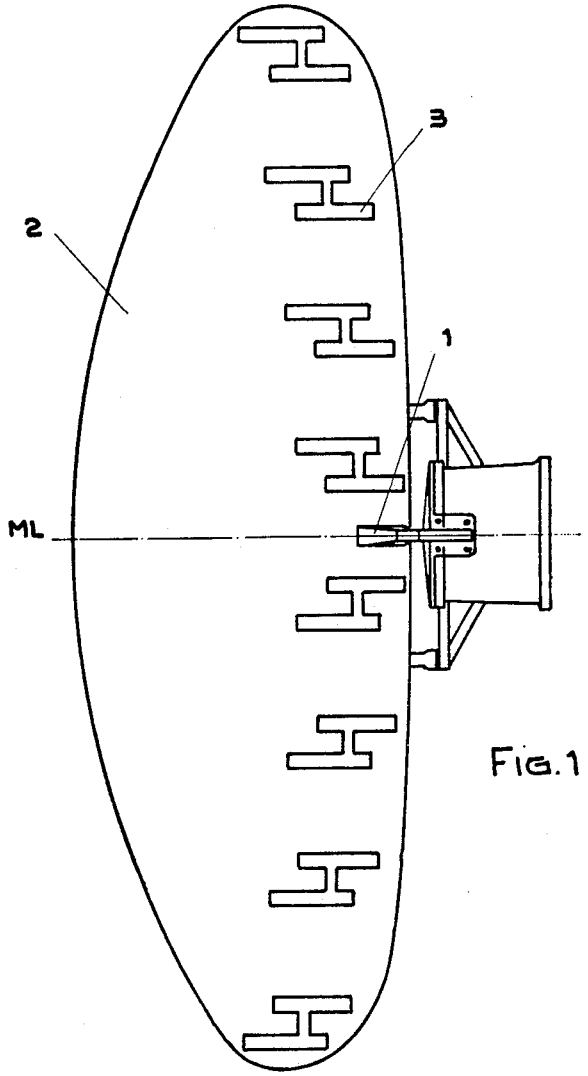
FIG. 1 is a front view of a possible emodiment of the integrated antenna array according to the invention.

In the integrated antenna array illustrated in FIG. 1, 1 designates an exciter positioned at the focal length of a double curvature reflector 2 with different hight and width dimensions. Mounted on this reflector are two groups of four micro strip surfaces 3 each, one group on the left of the vertical center line (ML), and the other, with inverted sides, on the right of the vertical center line (ML). In this example the inverted positioning of the groups is desired to obtain a symmetrical radiation pattern.

Figure 2:
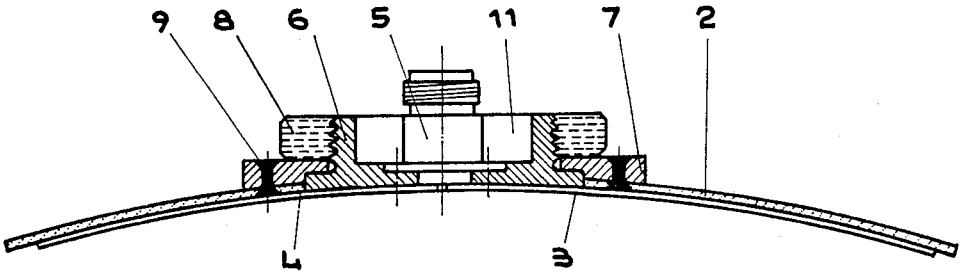
FIG. 2 is a side view of an axial cross-section through the reflector with micro strip radiating surface and support system.
Figure 3:
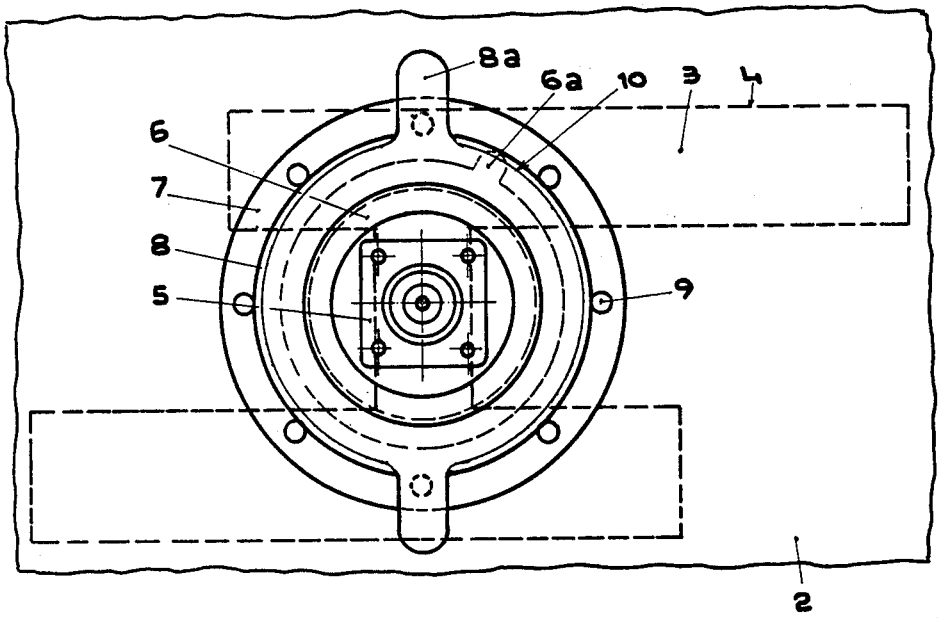
FIG. 3 is a front view of the support system on the rear side of the reflector.

The single radiating surface 3 looks very like in its shape the letter "H", whereas the two vertical strips, different in their dimension, resonate at predetermined frequencies. The horizontal strip of the "H" is intended for feeding purposes, the feeding being effected on the rear side of the reflector. As shown in FIGS. 2 and 3, the reflector is perforated at a suitable point for securing the micro strip surfaces, whereupon a stop ring 7 is secured on the reflector 2 with the aid of rivets 9. Both the reflector 2 and the stop ring 7 are milled at a point 10 so as to provide a backing point for a positioning cam 6*a*. In this support, thus provided, there is inserted a bearing ring 6 with a positioning cam 6*a* corresponding to the point 10 and locked by means of a ring nut. This ring nut 8 has two handles 8*a* which enable a manual mounting. Inside the bearing ring there is a milled counterbore 11 with a hole in which a high frequency connector 5 will be inserted. In the example shown a connector of the "N" type is secured with screws not shown in the drawing.

The surface of the bearing ring 6 on the inside of the reflector is fitted to the double curvature of the reflector. Only the inner conductor of the socket 5 goes through the hole of the bearing ring 6 and projects from the surface. The bearing dielectric layer 4 of the micro strip surface 3 is in turn perforated about the point at which the feeding of the micro strip surface is effected and is positioned and stuck on the bearing ring 6 in such a manner that the inner conductor goes through said hole and can be soldered to the micro strip surface. The whole micro strip surface 3 is then protected by a lacquer layer or, if the mechanical stiffness of the bearing dielectric layer 4 is not sufficient, reinforced by a second dielectric layer which will be in turn stuck to the outside of the micro strip surface.

FIG. 3 shows a front view of the support on the rear side of the reflector.

Figure 4:
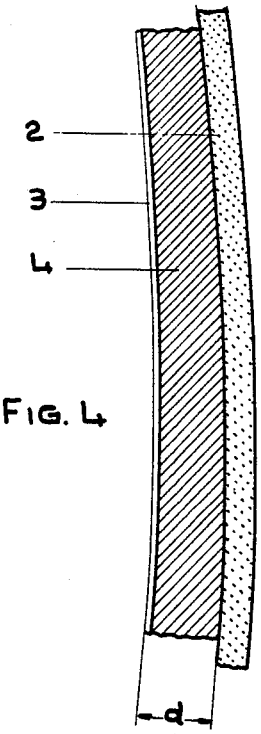
FIG. 4 is a partial, enlarged view of the cross-section through the reflector, according to FIG. 2.

The partial enlarged view of the axial cross-section of the reflector according to FIG. 2, shows in FIG. 4 that the dielectric material layer 4 keeps the micro strip surface perfectly parallel to the reflector surface 2 at a predetermined distance d. This distance d is defined according to the relationship $d=K\lambda/2$ where K can be 0,1,2,3 . . . n, and $\lambda$ is the wavelength of the frequency of the exciter 1. If $K=0$, this means that the dielectric layer 4 is very thin so that the phase shifting of the signals radiated by the exciter and reflected by the micro strip radiating surface 3 with respect to those reflected by the reflector 2 is negligible. If the factor K is made equal to 1,2, 3 or n, the phase shifting is equal to K. 360° and the signals reflected by the two surfaces 2 and 3 have again the same phase and the radiation pattern is not altered.

Figure 5:
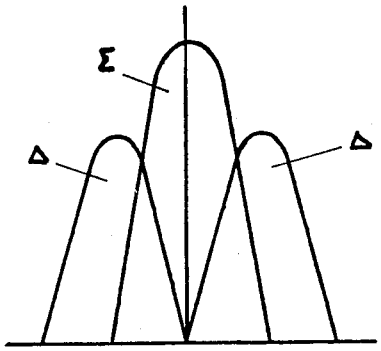
FIG. 5 is an example of a radiation pattern of an antenna provided with micro strip radiating surfaces.

The micro strip surfaces 3 can in turn be fed in groups or individually. In their usual use as IFF antennas they can provide a radiation pattern of the type shown in FIG. 5.

A particular advantage is that the above mentioned micro strip surfaces 3 mounted on the reflector 3 are removable. They can be easily mounted on existing reflectors, to whose curvature they fit because of their flexibility. In this manner the radar equipments can be incremented with supplemental antenna arrays for special use.

While but one embodiment of the invention has been illustrated and described, it is obvious that a number of changes and modifications can be made without departing from the scope of the invention.

What is claimed is:

1. An integrated radar antenna array, comprising:

(a) a double curvature reflector with different height and width dimensions;

(b) an exciter positioned at the focal point of said reflector for emitting electromagnetic radiation of a wavelength, λ; and (c) a micro strip surface congruent with said double curvature reflector for reflecting the electromagnetic radiation emitted by said exciter and radiating electromagnetic radiation at a wavelength other than λ, said micro strip surface being spaced from said double curvature reflector by a distance essentially equalling an integer multiple of λ/2 and means associated with said reflector for feeding signals to said micro strip surface.

2. An integrated radar antenna array consisting of a first antenna, in which an exciter is positioned at the focal length of a double curvature reflector with different hight and width dimensions to generate a first directional radiation pattern, and a second antenna comprising the reflector of the first antenna and a plurality of micro strip surfaces fitted to the double curvature of the reflector and suitably secured thereon and means associated with said reflector for feeding signals to said micro strip surfaces, characterized in that the radiating micro strip surface is positioned on the reflector at a distance $d=K\lambda/2$, where λ=wavelength of the exciter frequency and K essentially=0,1,2,3 . . . n.

3. An integrated radar antenna array as claimed in claim 1, characterized in that the micro strip radiating surface is removably secured on the reflector.

* * * * *